US005562033A

United States Patent [19]

Schild et al.

[11] Patent Number: 5,562,033

[45] Date of Patent: Oct. 8, 1996

[54] SUSPENSION SYSTEM FOR A PLATE NIPPING ELEMENT IN A PRINTING MACHINE

[75] Inventors: Helmut Schild, Steinbach; Berthold Seib, Rodgau, both of Germany

[73] Assignee: MAN Roland Druckmaschinen AG, Germany

[21] Appl. No.: 546,100

[22] Filed: Oct. 20, 1995

[30] Foreign Application Priority Data

Oct. 29, 1994 [DE] Germany ..... 44 48 754.7

[51] Int. Cl.[6] ..... B41F 5/00

[52] U.S. Cl. ..... 101/216; 101/425; 101/477

[58] Field of Search ..... 101/216, 415.1, 101/477, DIG. 36, 425

[56] References Cited

U.S. PATENT DOCUMENTS

| | | | |
|---|---|---|---|
| 3,828,672 | 8/1974 | Gazzola et al. | 101/247 |
| 5,293,820 | 3/1994 | Maejima et al. | 101/415.1 |
| 5,339,738 | 8/1994 | Blaser et al. | 101/477 |
| 5,363,764 | 11/1994 | Horiguchi et al. | 101/477 |
| 5,454,317 | 10/1995 | Kobler et al. | 101/477 |
| 5,476,711 | 11/1995 | Maejima | 101/216 |
| 5,483,892 | 1/1996 | Stiel | 101/477 |

FOREIGN PATENT DOCUMENTS

| | | |
|---|---|---|
| 4218602A1 | 3/1993 | Germany . |
| 4214207C1 | 7/1993 | Germany . |
| 4227683C2 | 4/1994 | Germany . |
| 62-169646A | 7/1987 | Japan . |

*Primary Examiner*—Eugene H. Eickholt
*Attorney, Agent, or Firm*—Leydig, Voit & Mayer, Ltd.

[57] ABSTRACT

A suspension system which is used to mount a plate nipping element on the frame of a printing machine is provided. The suspension system includes a setting arrangement adapted to move the nipping element between a position where it is engaged against the circumferential surface of a plate cylinder and a position where the nipping element is disengaged from the plate cylinder after first executing an idle stroke. The suspension system also includes a spring means adapted to support the weight of the nipping element on the frame of the printing machine when the nipping element is disengaged from the plate cylinder. In addition, the setting arrangement and the spring are adapted to allow the disengaged nipping roller to pivot away from the plate cylinder further biasing the spring when an object contacts the nipping element.

9 Claims, 10 Drawing Sheets

SUSPENSION SYSTEM FOR A PLATE NIPPING ELEMENT IN A PRINTING MACHINE

FIELD OF THE INVENTION

The present invention relates generally to printing machines, and more particularly to a suspension system for a plate nipping element in a rotary printing machine.

BACKGROUND OF THE INVENTION

Typically, nipping elements are used to assist in the attachment of printing plates to the plate cylinders of a printing machine. In particular, nipping elements facilitate the attachment of a new printing plate to a cylinder by holding the new printing plate against the circumferential surface of the cylinder. Accordingly, nipping elements generally move between engaged and disengaged positions. In the engaged position the nipping element is urged against the circumferential surface of the cylinder thereby holding the new plate to the cylinder. In the disengaged position the nipping element is separated from the cylinder so as not to interfere with printing operations.

A nipping element of this type is known from DE 4,218,602 A1, in which the nipping element is designed as a roller that can be engaged against a cylinder in order both to facilitate insertion of a beveled end of the printing plate into a corresponding tension rail and to hold the printing plate to the circumferential surface of the cylinder during the attachment process. The nipping element is provided with a suspension system which moves the nipping roller between the engaged and disengaged positions. The suspension system includes a setting means and a spring which are arranged in series. The spring is provided in order to prevent injury to the operator of the printing machine in the event that his hand enters the gap between the disengaged nipping roller and the rotating cylinder. Thus, when an object, such as a hand, comes in contact with the disengaged nipping roller, the force generated by the contact causes the spring to compress thereby allowing the nipping roller to deflect away from the cylinder. The suspension system also includes a switching element which stops the printing machine when the disengaged nipping roller is deflected away the cylinder. However, the suspension system is not capable of holding the plate to the cylinder with a force large enough to ensure that the plate rests snugly on the surface of the cylinder because the setting element and the spring are arranged in series. Accordingly, in addition to allowing the disengaged nipping roller to deflect away from the cylinder, the compression of the spring helps the setting means generate the force used to hold the nipping roller against the cylinder when the nipping roller is in the engaged position. If a stiffer spring is provided in order to hold the plate more tightly against the cylinder it necessarily takes a greater force to deflect the disengaged nipping roller away from the cylinder. Therefore, a snug fit of the plates on the cylinder can be ensured only by compromising the safety of the operator.

DE 4,214,207 C1 discloses a nipping element comprising a nipping roller and a bent strip. The nipping roller and the bent strip are moved between the engaged and disengaged positions by a setting means. However, means are not provided to allow the disengaged nipping roller and bent strip to deflect away from the cylinder when they contact an object such as the hand of the operator. While the setting means are capable of holding the nipping roller and bent strip against the cylinder with a force sufficient to ensure a snug fit of the new plates on the cylinder, the design is disadvantageous because the problem of operator safety is not addressed.

DE 4,227,683 C2 discloses a nipping roller which is moved between the engaged and disengaged positions by a cylinder. Because the nipping roller and cylinder are not mounted to the side stand of the printing machine there is no apparent operator Safety problem that needs to be addressed.

JP 62-169646 A discloses a nipping element that includes a nipping roller which is moved between the engaged and disengaged positions by a pushing element. In addition, the nipping roller can move in the circumferential direction of the cylinder in order to facilitate the insertion of an end of the printing plate into a corresponding tension bar. However, the circumferential movement of the nipping roller introduces additional safety problems by increasing the number of places where the operator's hand may become caught.

OBJECTS AND SUMMARY OF THE INVENTION

It is an object of the invention to provide a suspension system for a nipping element which both ensures that the printing plates fit snugly on the plate cylinder and provides maximum operator safety.

In accordance with these and other objects of the invention, a suspension system for a nipping element is provided for use in a rotary printing machine. The suspension system is used to mount the nipping element to the frame of the printing machine. The suspension system includes a setting arrangement which is adapted to move the nipping element between a position where the nipping element is engaged against the circumferential surface of the plate cylinder and a position where the nipping element is disengaged from the plate cylinder after first executing an idle stroke. In addition, the suspension system also includes a spring which is adapted to support the weight of the nipping roller on the frame of the printing machine when the nipping roller is in the disengaged position. Further, the setting arrangement and the spring allow the nipping element to pivot away from the plate cylinder further biasing the spring when the disengaged nipping roller is contacted by an object such as the hand of an operator.

In one embodiment of this invention the setting arrangement includes a pneumatic cylinder and a bushing. The bushing has an opening formed therein which is adapted to receive the piston rod of the pneumatic cylinder. A head having a diameter larger than the opening in the bushing is formed on the end of the piston rod which extends through the opening into the interior of the bushing. A sleeve is mounted on the piston rod a distance below the head. In this embodiment, the spring is arranged coaxially with the piston rod between the upper end of the pneumatic cylinder and the lower end of the bushing.

In order to move the nipping element into engagement with the circumferential surface of the plate cylinder the piston rod of the pneumatic cylinder is extended. Until the sleeve contacts the lower end of the bushing the extension of the piston rod is essentially an idle stroke. Once the sleeve contacts the bushing, the piston rod continues to extend thereby pushing the bushing. The movement of the bushing acting through a two-arm lever pivots the nipping element into engagement with the plate cylinder.

If an object contacts the nipping element when it is disengaged from the plate cylinder, the nipping element can pivot away from the plate cylinder. In particular, the force on the nipping element is transmitted through the two-arm lever to the bushing. Due to the arrangement of the spring, the piston rod, and the bushing, the force on the bushing causes the bushing to slide along the piston rod towards the stop thereby further compressing the spring. The movement of the bushing and the compression of the spring allows the nipping element to pivot away from the plate cylinder.

In an alternative embodiment of the invention, the setting arrangement includes a pair of levers, a hinge pin, and a pneumatic cylinder. The nipping element is attached to a first nipping lever which is pivotally connected to a hinge pin. A second cylinder lever is attached to the pneumatic cylinder and also is pivotally connected to the hinge pin. First and second stops are formed on the nipping lever and a knob, which is disposed between the two stops, is attached to the cylinder lever. In this embodiment, the spring is attached to the second stop and to the frame of the printing machine.

As in the first embodiment, in order to move the nipping element into engagement with the circumferential surface of the plate cylinder, the piston rod of the pneumatic cylinder is extended. The extension of the piston rod causes the cylinder lever to pivot thereby moving the knob away from the second stop and towards the first stop. Until the knob contacts the first stop the extension of the piston rod is essentially an idle stroke. Once the knob contacts the first stop, the piston rod continues to extend thereby pushing the first stop. The force on the first stop causes the nipping lever to pivot thereby bringing the nipping element into engagement with the plate cylinder.

In this embodiment, similar to the first embodiment, if an object contacts the nipping element when the nipping element is disengaged from the plate cylinder, the nipping element can pivot away from the plate cylinder. The force of the contact transmitted through the nipping lever causes the first and second stops to rotate. The rotation of the second knob causes the spring to further compress thereby allowing the nipping element to pivot away from the plate cylinder.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
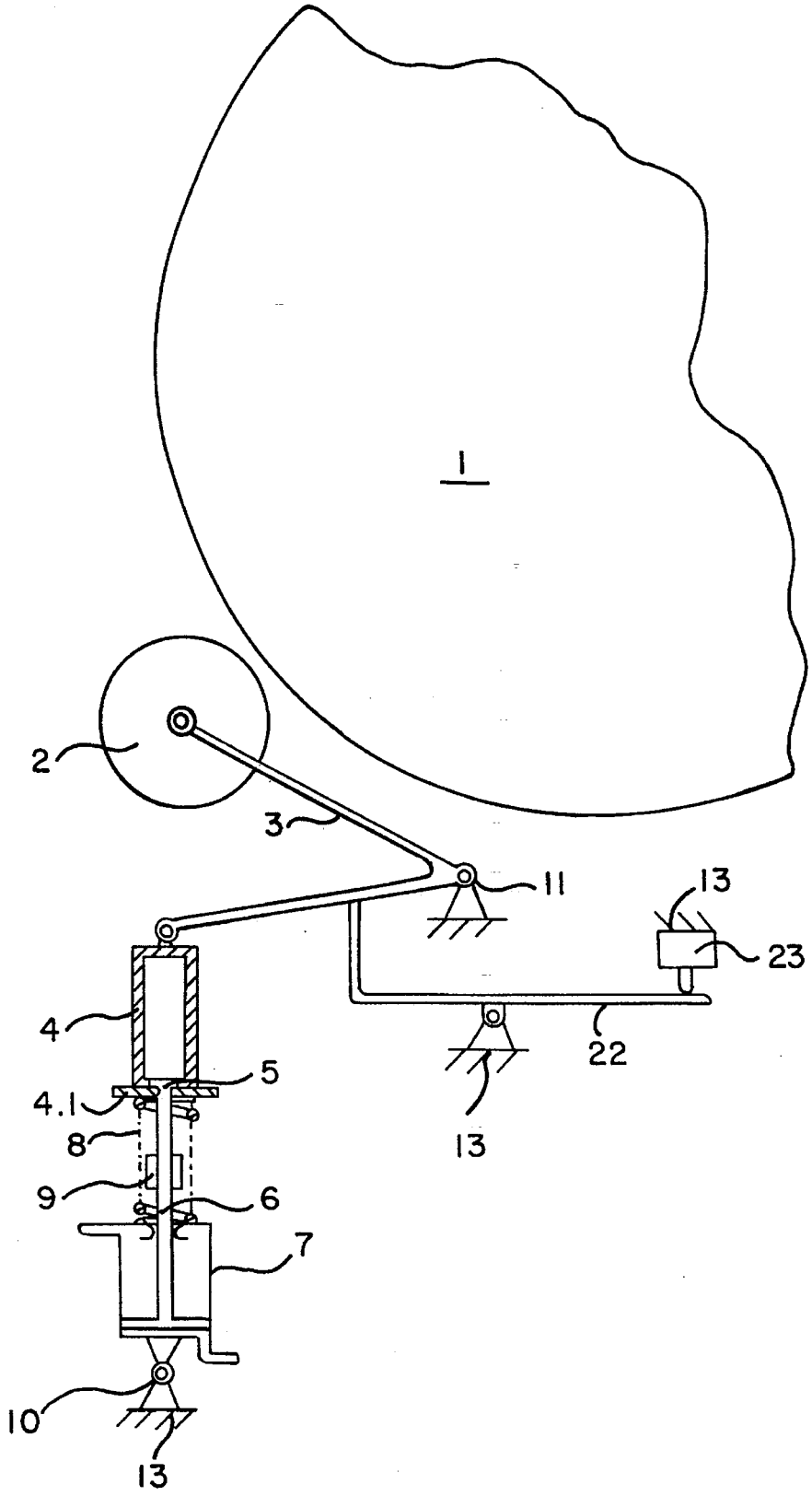
FIG. 1 is a schematic side view of a suspension system for a nipping element of the present invention showing the suspension system with the nipping element in the disengaged position.

FIG. 1 illustrates in schematic form a plate cylinder 1 of a printing machine having a nipping element which is in the form of a nipping roller 2. As shown in FIG. 1, the plate cylinder 1 and nipping roller 2 are arranged so that their axes of rotation are parallel. In a known manner, the nipping roller 2 is used to attach printing plates (not shown) to the plate cylinder 1. While the illustrated nipping element is a nipping roller it is understood that the nipping element could also be designed as washing device or arranged within a washing device. The nipping roller 2 is mounted to the frame 13 of the printing machine using a suspension system which can move the nipping roller 2 such that it can be engaged against and disengaged from the plate cylinder 1. The suspension system is also adapted to allow the nipping roller 2 to pivot further away from the plate cylinder 1 when the disengaged nipping roller 2 is contacted by an object such as the hand of an operator.

Figure 2:
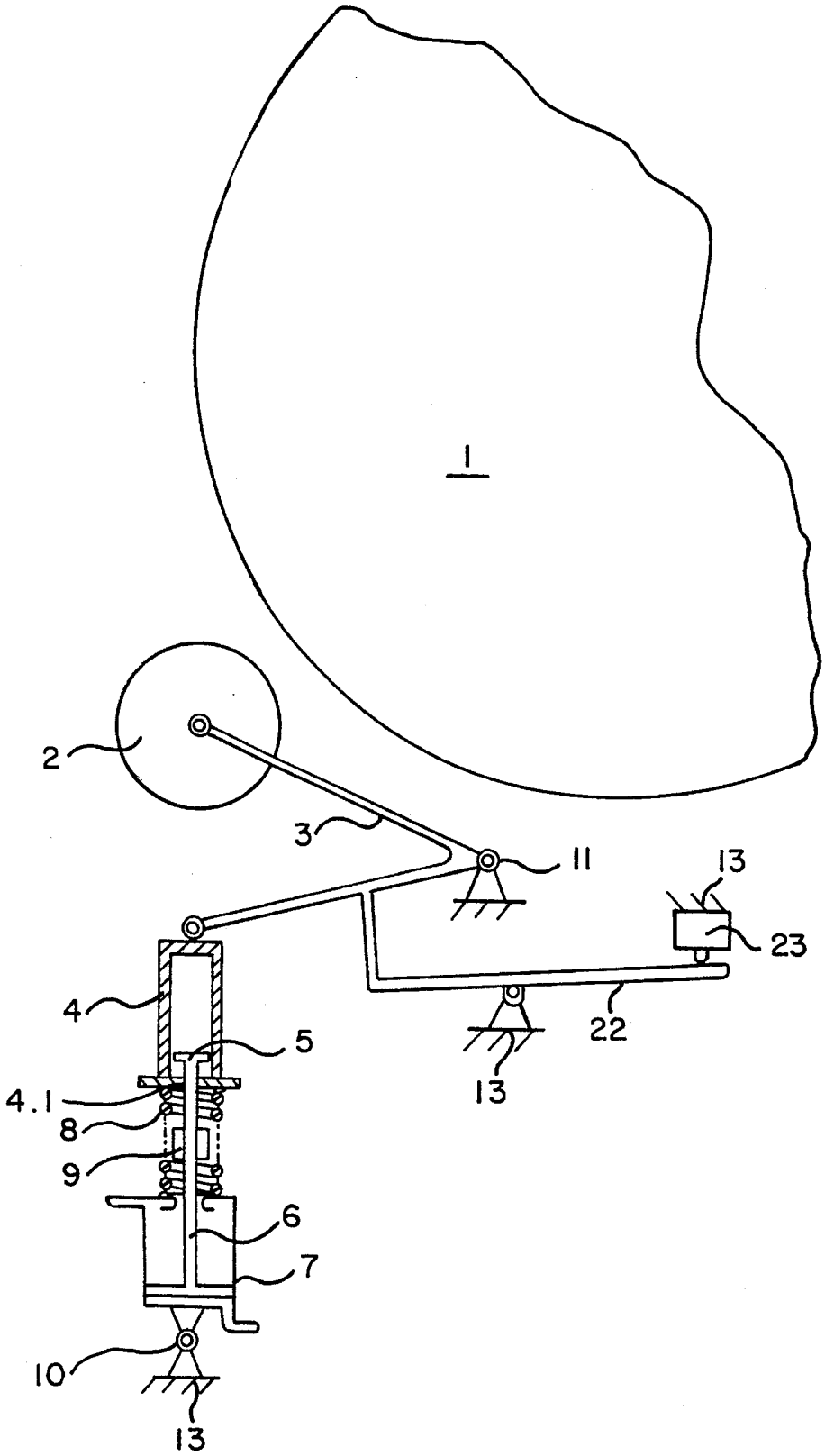
FIG. 2 is a schematic side view of the present invention showing the suspension system with the nipping element pivoted away from the disengaged position.
Figure 3:
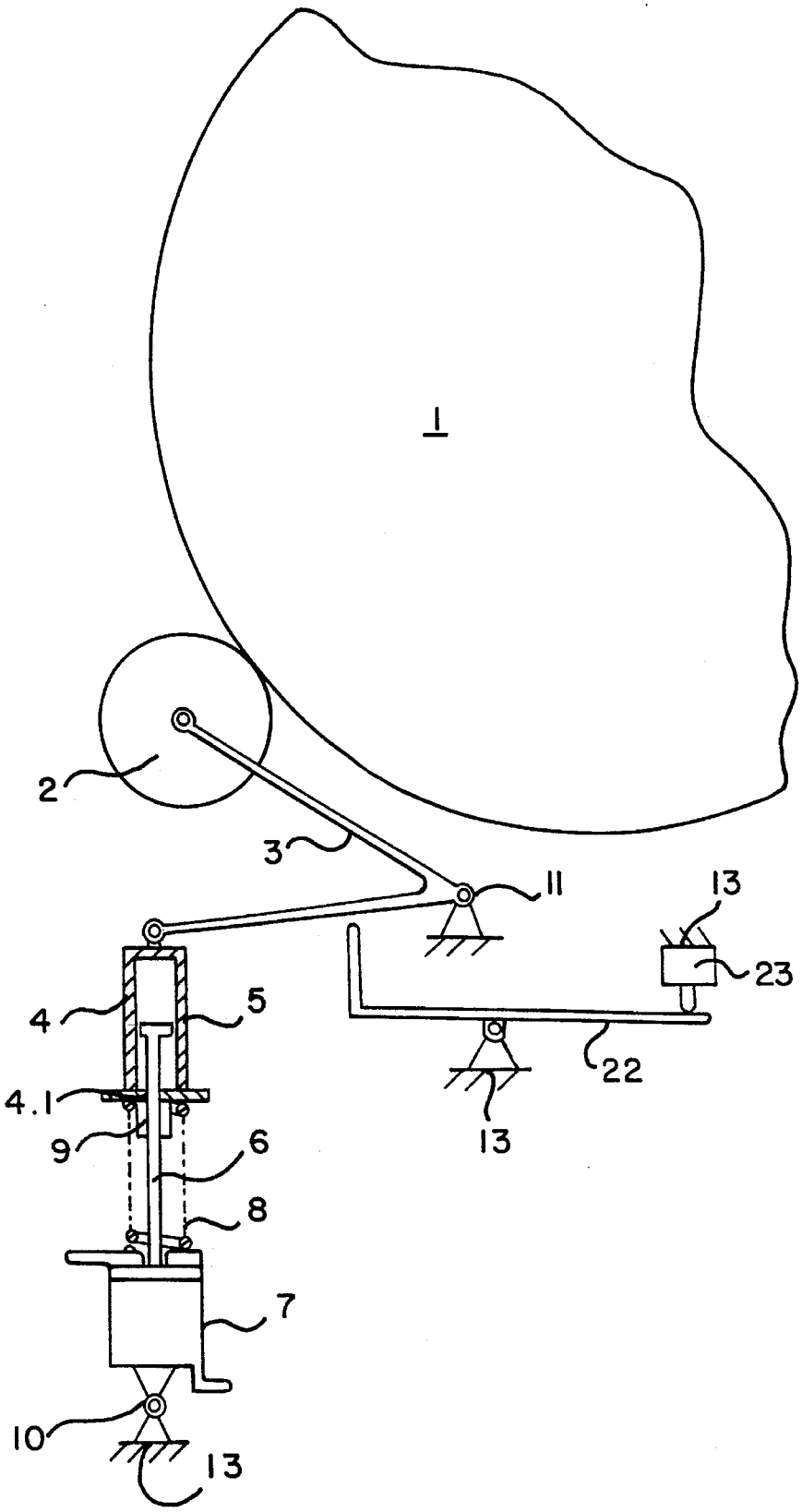
FIG. 3 is a schematic side view of the present invention showing the suspension system with the nipping element in the engaged position.
Figure 4:
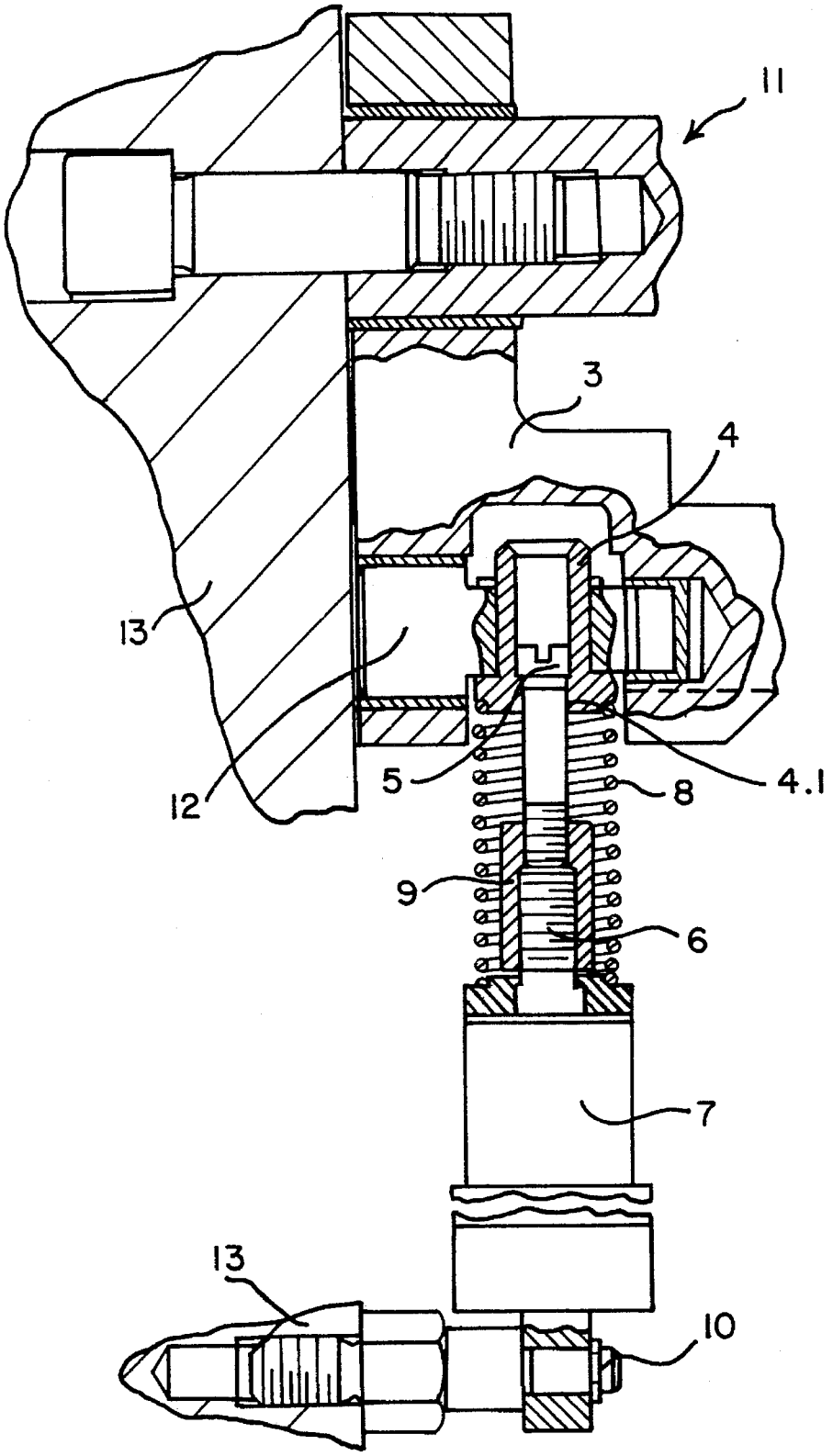
FIG. 4 is an enlarged partial side view of the suspension system showing the suspension system when the nipping element is in the engaged position.
Figure 5:
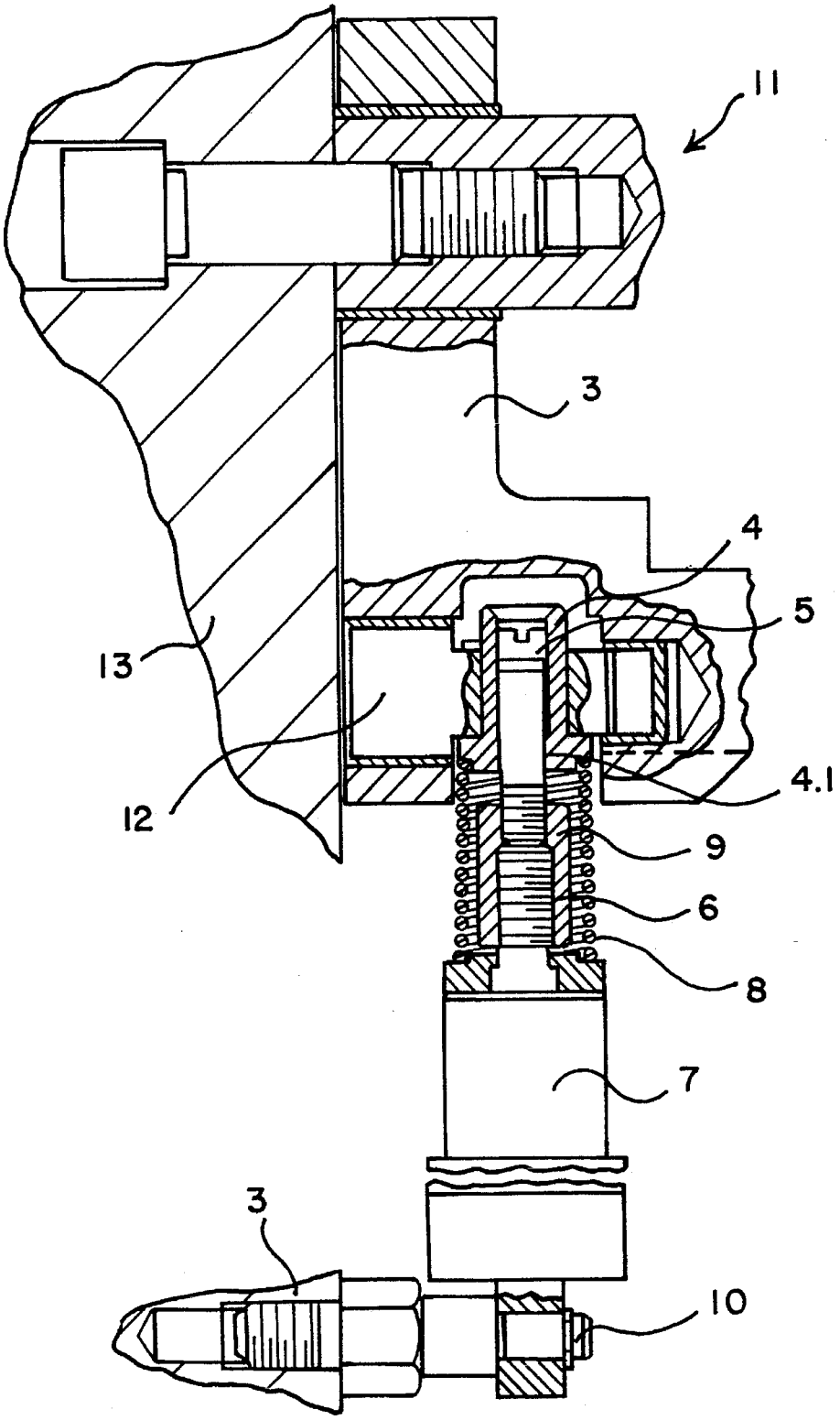
FIG. 5 is an enlarged partial side view of the suspension system showing the suspension system when the nipping element has pivoted away from the disengaged position.
Figure 6:
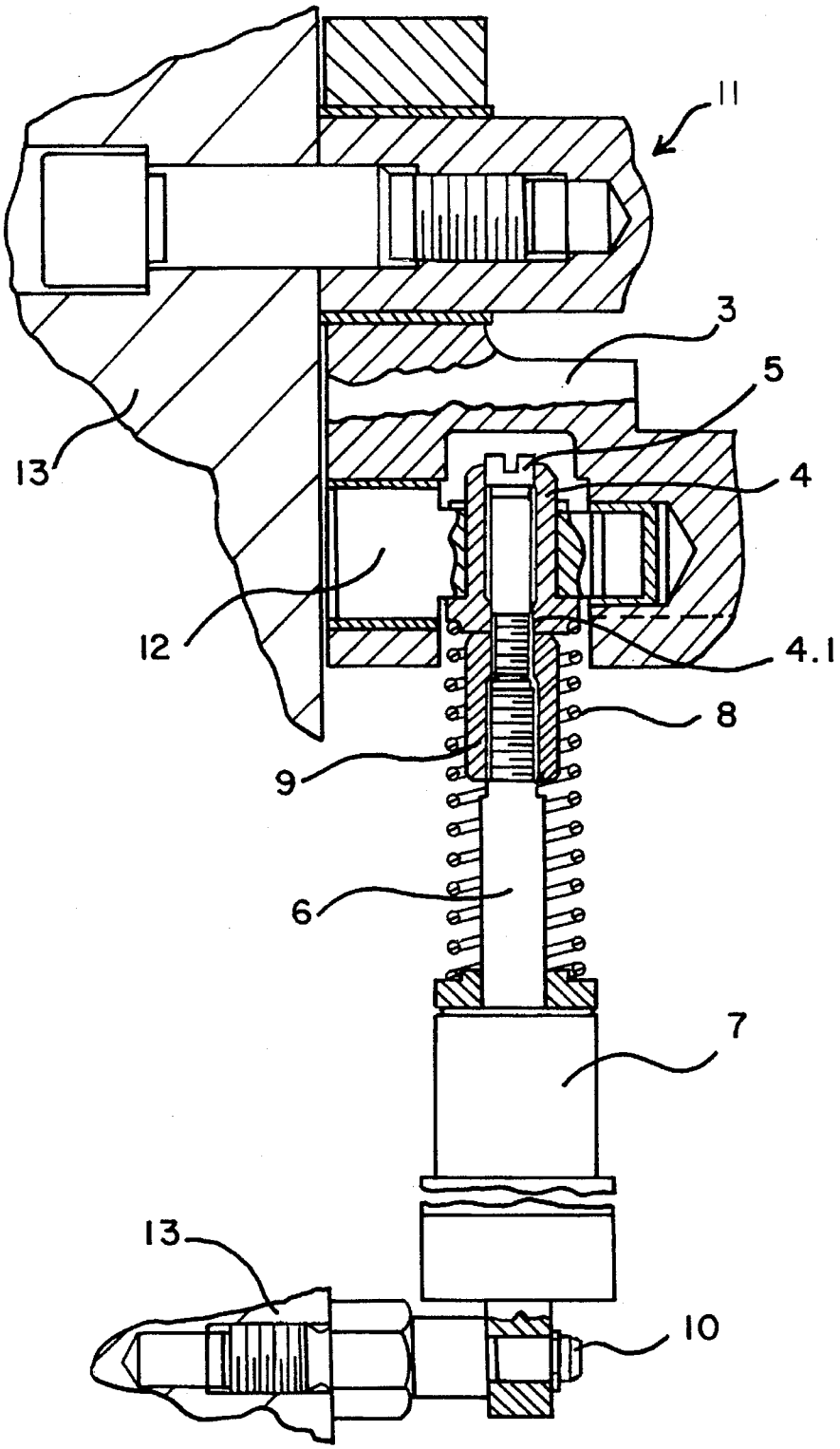
FIG. 6 is an enlarged partial side view of the suspension system showing the suspension system when the nipping element is in the engaged position.

In the embodiment of the invention shown in FIGS. 1–3, each end of the nipping roller 2 is pivotally attached to the end of a two-arm lever 3 which is pivotally attached to a joint 11 that is fixed to the frame 13 of the printing machine. As shown in FIGS. 4–6, the joint 11 pivotally attaching the two-arm lever 3 to the frame 13 comprises a bolt which is recessed into the frame wall. The second end of the two-arm lever 3 is attached to a setting means which is adapted to move the nipping roller 2 between the engaged and disengaged positions. The setting means includes a pneumatic cylinder 7 and a bushing 4. In particular, the second arm of the two-arm-lever 3 is attached to the upper end of a bushing 4. The lower end of the bushing 4 has an opening 4.1 which is adapted to receive the shaft of the piston rod 6 of the pneumatic cylinder 7. As shown in FIGS. 4–6, the bushing 4 is recessed into a hinge pin 12 mounted on the two-arm lever 3. A head 5 having a diameter greater than the diameter of the opening 4.1 in the lower end of the bushing 4 is formed on the portion of the piston rod 6 which extends through the opening 4.1 into the interior of the bushing 4. The opening 4.1 in the lower end of the bushing 4 and the shaft of the piston rod 6 are dimensioned so that the shaft can slide linearly in the opening 4.1.

The lower end of the pneumatic cylinder 7 is pivotally attached to a joint 10 which is fixed on the frame 13 of the printing machine. A spring means is provided which is adapted to support the weight of the nipping roller 2 when the nipping roller 2 is disengaged from the plate cylinder 1. The spring means, which in the preferred embodiment is a coiled spring 8, is arranged coaxially with the piston rod 6 between the upper end of the pneumatic cylinder 7 and the lower end of the bushing 4. When the nipping roller 2 is in the disengaged position, as shown in FIGS. 1 and 4, the spring 8 pushes against the bottom of the bushing 4 so that the bottom of the interior of the bushing presses against the head 5 on the end of the piston rod 6. Thus, the bias of the spring 8 acting through the two-arm lever 3 supports the nipping roller 2 on the frame 13 of the printing machine.

If an object contacts the nipping roller 2 when it is in the disengaged position, as shown in FIGS. 1 and 4, the nipping roller 2 is able to pivot away from the plate cylinder 1 about the joint 11 attaching the two-arm lever 3 to the frame 13 due to the arrangement of the spring 8, the pneumatic cylinder 7, and the bushing 4. More particularly, the contact force acting through the two arm lever 3 applies a force on the bushing 4. As shown in FIGS. 2 and 5, the force on the bushing 4 causes the bushing to slide down the piston rod 6 of the pneumatic cylinder 7 thereby further compressing or biasing the spring 8. Thus, the sliding of the bushing 4 on the piston rod 6 and the compression of the spring 8 allows the nipping roller 2 to pivot further away from the plate cylinder 1. In addition, the suspension system for the nipping roller 2 is adapted to shut-down the printing machine when the nipping roller pivots away from its disengaged position. In particular, as shown in FIG. 2, the pivoting away of the nipping roller 2 is transmitted via the two-arm lever 3 to a switching lever 22 which engages a switch 23 that triggers the shut-down of the printing machine.

As shown in FIGS. 3 and 6, the nipping roller 2 is moved into the position where it is engaged against the circumferential surface of the plate cylinder 1 by the extension of the piston rod 6 of the pneumatic cylinder 7. A sleeve 9 is mounted on the shaft of the piston rod 6 a predetermined distance below the head 5. Until the sleeve 9 contacts the underside of the bushing 4, the extension of the piston rod 6 is essentially an idle stroke. Once the sleeve 9 contacts the underside of the bushing 4, the piston rod 6 continues to extend thereby forcing the bushing 4 upward, as shown in FIGS. 3 and 6. As seen in FIG. 3, the upward movement of the bushing 4 transmitted through the two-arm lever 3 causes the nipping roller 2 to pivot towards and then engage the plate cylinder 1. The upward movement of the bushing 4 also relieves the bias in the spring 8 caused by the weight of the disengaged nipping roller.

As best shown in FIGS. 4–6, the head 5 has a threaded shank which screws into a threaded opening formed in the sleeve 9. The sleeve 9, in turn, is screwed via another threaded portion to the end of the piston rod 6. The distance between the sleeve 9 and the head 5 and the resulting idle stroke are necessary in order to allow the bushing 4 to slide down the shaft of the piston rod 6 thereby compressing the spring 8 when the nipping roller 2 deflects away from the plate cylinder 1. Accordingly, the sleeve 9 and the head 5 limit the movement of the bushing 4 relative to the piston rod 6 when the nipping roller 2 pivots away from the disengaged position and limits the movement of the piston rod 6 relative to the bushing 4 when the nipping roller 2 is being moved into the engaged position.

Figure 7:
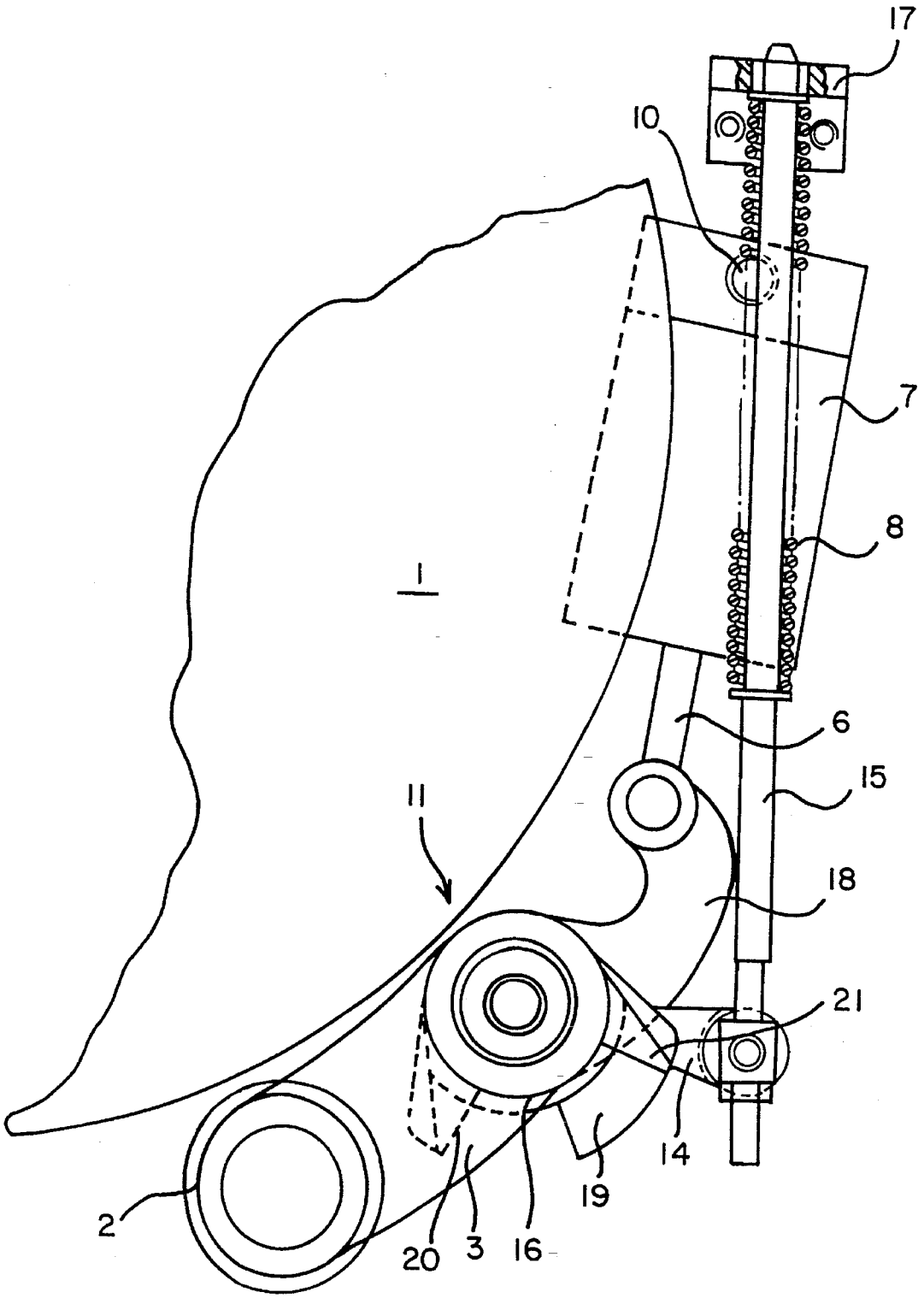
FIG. 7 is a schematic side view of an alternative embodiment of the present invention showing the Suspension system with the nipping element in the disengaged position.
Figure 8:
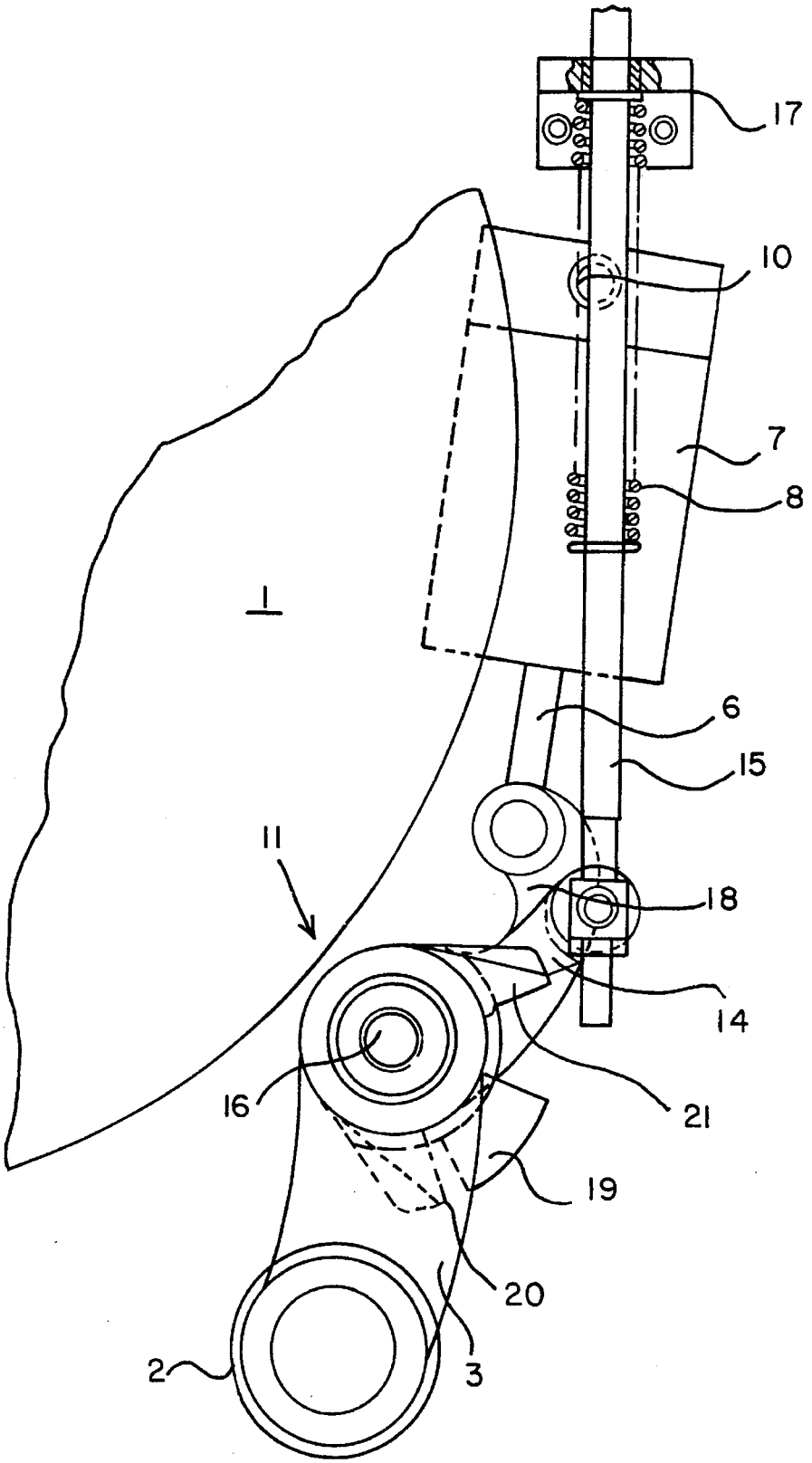
FIG. 8 is a schematic side view of the alternative embodiment of FIG. 7 showing the suspension system with the nipping element pivoted away from the disengaged position.
Figure 9:
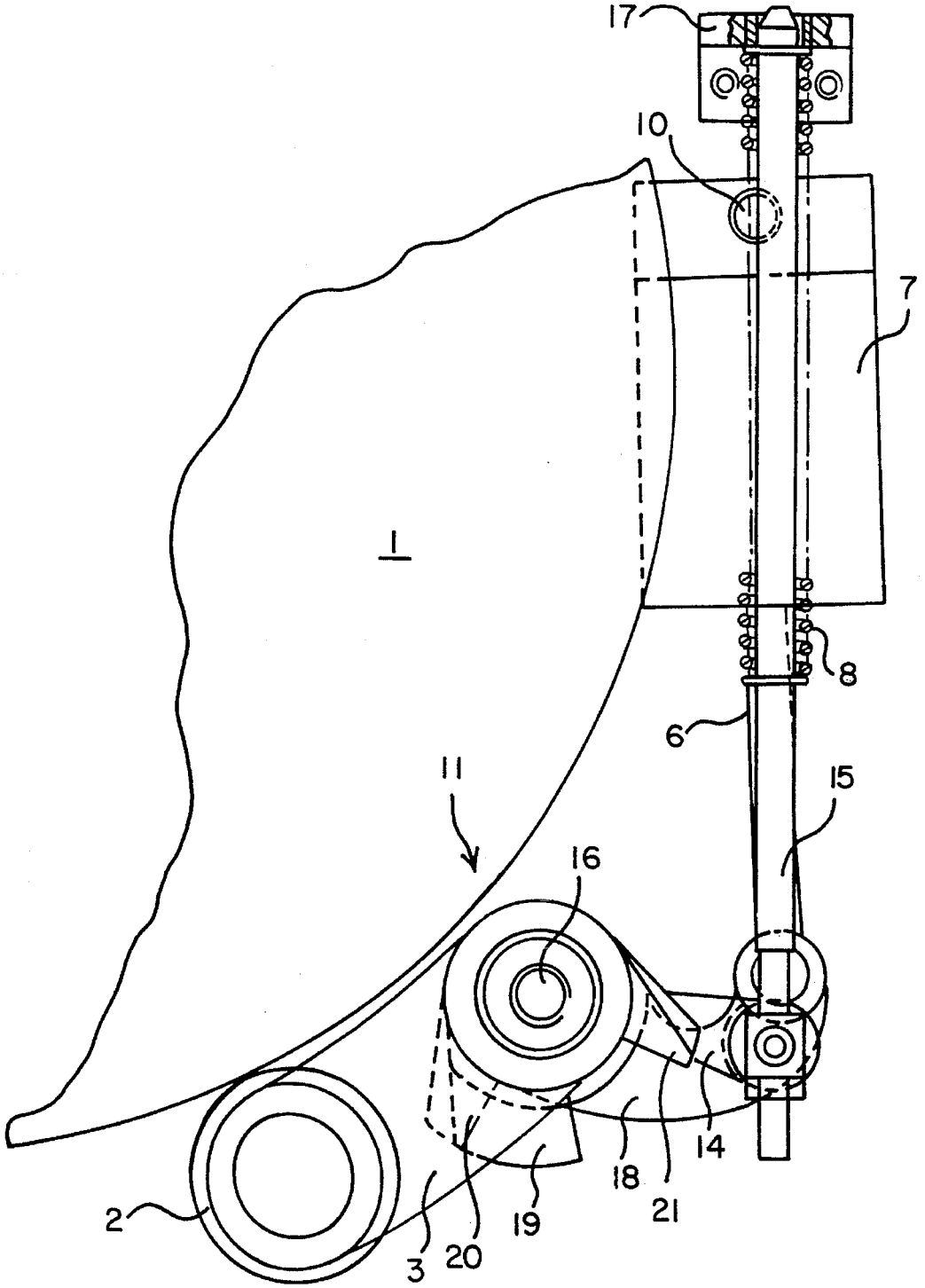
FIG. 9 is a schematic side view of the alternative embodiment of FIG. 7 showing the suspension system with the nipping element in the engaged position.
Figure 10:
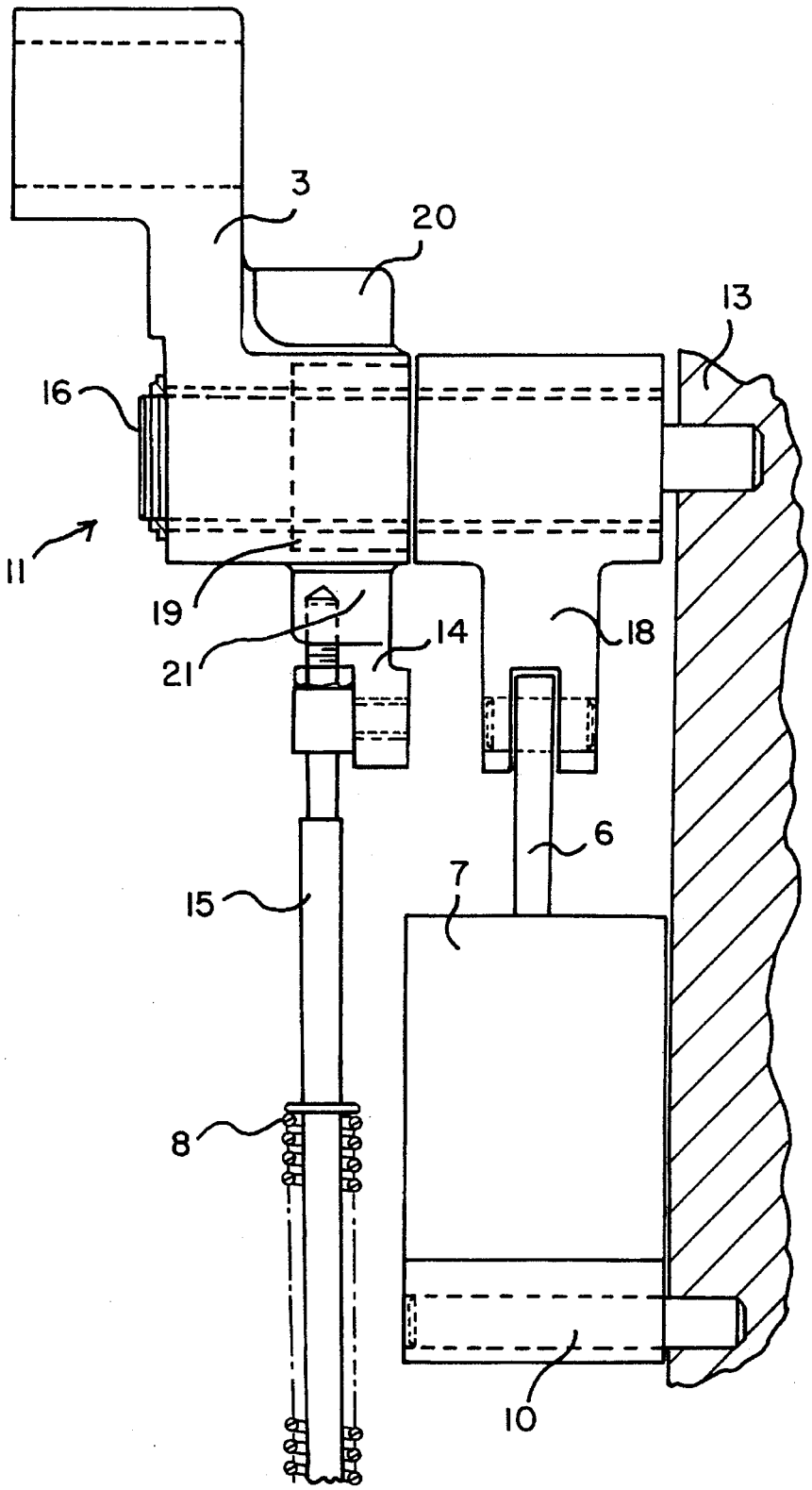
FIG. 10 is an enlarged partial end view of the alternative embodiment of FIG. 7 showing the arrangement of the spring and setting means.

An alternative embodiment of the suspension system is depicted in FIGS. 7–10. In this embodiment, as shown in FIG. 7, the setting means includes first and second levers, a hinge pin, and a pneumatic cylinder. In particular, each end of the nipping roller 2 is pivotally attached to the end of a first nipping lever 3 which has a claw-like shape. The joint of the nipping lever 3 is formed by a hinge pin 16 which is fixed to the wall of the frame 13 of the printing machine. The end of a second cylinder lever 18 is also pivotally attached to the shank of the hinge pin 16. As shown in FIG. 10, the nipping lever 3 and the cylinder lever 18 are mounted on the hinge pin 16 in different planes such that the two levers 3, 18 are pivotable independently of one another. The opposite end of the cylinder lever 18 is pivotally attached to the piston rod end of a pneumatic cylinder 7 which is pivotally attached via a joint 10 to the frame 13 of the printing machine.

First and second stops 20, 21 are rigidly connected to the nipping lever 3 a predetermined distance from each other. In addition, a knob 19 is rigidly attached to the cylinder lever 18 so that it is disposed between the two stops 20, 21. Thus, as the piston rod 6 of the pneumatic cylinder 7 extends and retracts it pivots the cylinder lever 18 such that the knob 19 moves between the two stops 20, 21. A third lever arm 14 is rigidly attached to the second stop 21. The third lever arm 14 is also connected in articulated manner to the end of a rod 15 which is under the pre-stress of spring means. The spring means, which in the illustrated embodiment is a coiled spring 8, is fixed to the frame of the printing machine via a support bearing 17. The bias of the spring 8 acting through the third lever arm 14 holds the nipping lever 3 and the nipping roller 2 in the disengaged position, as shown in FIG. 7. In other words, the spring 8 is adapted to support the weight of the nipping roller 2 when it is disengaged from the plate cylinder 1. More particularly, the bias of the spring 8 is transmitted via the rod 15 to the third lever arm 14 so that the surface of the second stop 21 is pressed against the associated surface of the knob 19. The piston rod 6 of the pneumatic cylinder 7 is in the retracted position such that by means of the knob 19 connected to the cylinder lever 18, the nipping roller 2 is held via the nipping lever 3 at a defined distance from the surface of the plate cylinder 1.

As with the embodiment shown in FIGS. 1–6, if an object contacts the nipping roller 2 when the nipping roller is in the position disengaged from the plate cylinder 1 the nipping roller can pivot away from the plate cylinder. In particular, a force contacting the nipping roller 2 pivots the nipping roller 2 counter to the force of the spring 8 about the hinge pin 16 away from the plate cylinder 1, as shown in FIG. 8. As the nipping roller 2 pivots away from the plate cylinder 1, the stops 20, 21 rotate counter-clockwise about the hinge pin 16. The counter-clockwise rotation of the stops 20, 21 further compresses or biases the spring 8 via the third lever arm 14 connecting the rod 15 to the second stop 21. Thus, the nipping roller 2 can pivot away from the plate cylinder 1 to a specific angle which is dependent on the spacing of the two stops 20, 21 and the size of knob 19. In addition, switching means (not shown) are provided for triggering the stoppage of the printing machine upon the pivoting away of the nipping roller.

In the embodiment of FIGS. 7–10, similar to the embodiment shown in FIGS. 1–6, the nipping roller 2 is moved into the position where it is engaged against the plate cylinder 1 by the extension of the piston rod 6 of the operating cylinder 7. As shown in FIG. 9, the extension of the piston rod 6 pushes the cylinder lever 18 thereby causing the knob 19 to rotate clockwise about the hinge pin 16 between the two stops 20, 21. Until the knob 19 contacts the first stop 20, the extension of the piston rod 6 is essentially an idle stroke which corresponds to the difference between the spacing of the surfaces of the stops and the size of knob. Once the knob 19 contacts the first stop 20, as shown in FIG. 9, the piston rod 6 continues to extend thereby rotating the first stop 20 clockwise about the hinge pin 16. The clockwise rotation of the first stop 20 pivots the nipping lever 3 thereby moving the nipping roller 2 into engagement with the plate cylinder 1. The pivoting of the nipping lever 3 also relieves the bias in the spring 8 caused by the weight of the disengaged nipping roller via the third lever arm 14 connecting the rod 15 to the stop 21. The two stops 20, 21 and the knob 19 and the resulting idle stroke are necessary to allow the nipping roller 2 to pivot away from the plate cylinder 1 when the nipping roller 2 is disengaged from the plate cylinder. Accordingly, the two stops and the knob limit the movement of the nipping lever 3 relative to the cylinder lever 18 when the nipping roller pivots away from the disengaged position and limits the movement of the cylinder lever 18 relative to the nipping lever 3 when the nipping roller is being moved into engagement with the plate cylinder.

In both the embodiment shown in FIGS. 1–6 and the embodiment shown in FIGS. 7–10, the spring 8 is designed with a spring constant such that the bias of the spring just compensates the weight of the nipping roller when it is in the disengaged position. Thus, it is assured that only a very small force is necessary to pivot the nipping roller 2 away from the plate cylinder 1. Accordingly, the risk of injury to the operator is minimized.

While this invention has been described with an emphasis upon certain preferred embodiments, it will be obvious to those of ordinary skill in the art that variations of the preferred embodiments may be used and that it is intended that the invention may be practiced otherwise than as specifically described herein. Accordingly, it is also intended that this invention includes all modifications encompassed within the spirit and scope of the invention as defined by the following claims.

We claim as our invention:

1. A suspension system for mounting on a frame of a printing machine a nipping element that serves to hold a printing plate on a cylinder in said printing machine, said suspension system comprising, in combination:

setting means for moving said nipping element between a position where said nipping element is engaged against the circumferential surface of said cylinder and a position where said nipping element is disengaged from said cylinder wherein said setting means first executes an idle stroke;

spring means fixed to said frame for supporting said nipping element with a biasing force when said nipping element is in said disengaged position;

said setting means and said spring means being disposed and adapted such that said nipping element can pivot further away from said cylinder additionally biasing said spring means when said nipping element is in said disengaged position and an object contacts said nipping roller.

2. A suspension system for a nipping element as defined in claim 1 wherein said setting means includes a pneumatic cylinder pivotally attached to said frame and having a top end and a piston rod, a bushing having an opening formed therein which is adapted to receive said piston rod and dimensioned such that said piston rod can slide in said opening, an enlarged head attached to the end of said piston rod which is contained in said bushing, and a sleeve attached to said piston rod a predetermined distance below said head whereby said sleeve and said head limit the movement of said piston rod and said bushing relative to each other and said predetermined distance between said head and said sleeve corresponds to said idle stroke.

3. A suspension system for a nipping element as defined in claim 2 wherein said spring means is arranged coaxially with said piston rod and is disposed between the bottom end of said bushing and the top end of said pneumatic cylinder.

4. A suspension system for a nipping element as defined in claim 2 wherein said nipping element is a rotatable roller.

5. A suspension system for a nipping element as defined in claim 2 wherein said nipping element washes the surface of said cylinder.

6. A suspension system for a nipping element as defined in claim 1 wherein said setting means includes a pneumatic cylinder, a hinge pin attached to said frame, and first and second levers each having opposing ends wherein one end of each of said levers is pivotally attached to said hinge pin, said first lever has two stops attached thereto that are spaced a predetermined distance from each other and said opposing end is pivotally attached to said nipping element and said spring means, and said second lever has a knob attached thereto that is disposed between said stops and said opposing end is pivotally attached to said pneumatic cylinder whereby said stops and said knob limit the movement of said first and second levers relative to each other and said idle stroke corresponds to the difference between said predetermined distance between said two stops and the size of said knob.

7. A suspension system for a nipping element as defined in claim 6 wherein said spring means is disposed such that said biasing force acts on a rod element that is pivotally attached to a third lever which is rigidly attached to one of said stops.

8. A suspension system for a nipping element as defined in claim 6 wherein said nipping element is a rotatable roller.

9. A suspension system for a nipping element as defined in claim 6 wherein said nipping element washes the surface of said cylinder.

* * * * *